US006922477B1

(12) United States Patent
Ikeyama

(10) Patent No.: US 6,922,477 B1
(45) Date of Patent: Jul. 26, 2005

(54) SPEAKER

(75) Inventor: Junzo Ikeyama, Mie (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 263 days.

(21) Appl. No.: 10/148,388

(22) PCT Filed: Oct. 2, 2000

(86) PCT No.: PCT/JP00/06830

§ 371 (c)(1),
(2), (4) Date: Sep. 10, 2002

(87) PCT Pub. No.: WO02/30152

PCT Pub. Date: Apr. 11, 2002

Related U.S. Application Data

(60) Provisional application No. 60/163,459, filed on Nov. 4, 1999.

(51) Int. Cl.[7] ..... H04R 25/00
(52) U.S. Cl. ..... 381/409; 381/400
(58) Field of Search ..... 381/396, 400, 381/409, 410, 411, 433, 398, 399, 404, 407

(56) References Cited

U.S. PATENT DOCUMENTS

| | | | | | |
|---|---|---|---|---|---|
| 1,930,600 | A | * | 10/1933 | Tolerton | 381/409 |
| 3,609,652 | A | * | 9/1971 | Sebastian | 381/409 |
| 4,680,800 | A | * | 7/1987 | Bank et al. | 381/409 |
| 5,583,944 | A | | 12/1996 | Morohoshi et al. | |
| 5,838,809 | A | * | 11/1998 | Sato et al. | 381/409 |

FOREIGN PATENT DOCUMENTS

| | | |
|---|---|---|
| JP | 61-44992 | 3/1986 |
| JP | 2000-59887 | 2/2000 |

* cited by examiner

*Primary Examiner*—Suhan Ni
(74) *Attorney, Agent, or Firm*—Wenderoth, Lind & Ponack, L.L.P.

(57) ABSTRACT

A speaker has a relay portion disposed on a resin frame for relaying the connection between a terminal and a voice coil. The relay portion comprises a clamping section and a wall section, and is configured so that a flexible wire does not make contact with a diaphragm or a damper during operation of the speaker. The assembly operation for placing and fixing the flexible wire becomes quite easy, and the number of components can be reduced among the speakers in accordance with the present invention.

22 Claims, 12 Drawing Sheets

SPEAKER

This application is a 371 of PCT/JP00/06830 filed Oct. 2, 2000 which claims benefit of Provisional Appl. Ser. No. 60/163,459 filed Nov. 4, 1999.

TECHNICAL FIELD

The present invention relates to a loudspeaker (speaker) for use in television receivers, stereophonic apparatus, sound recording apparatus and the like audio-visual appliances, and more specifically, to a structure of the speaker.

BACKGROUND ART

Among the speakers developed recently, a terminal for connection with a sound signal amplifier is often disposed somewhere in a front part of the speaker for easy connection with an amplifier contained in an apparatus. The above-described arrangement for connection is popular among the speakers used in car-borne sound apparatus.

A conventional speaker is described referring to FIGS. 11 through 13.

As shown in FIGS. 11 through 13, a conventional speaker mainly comprises:

a. a magnetic circuit 7 formed of a bottom plate 7B having a center pole, a ring-shaped magnet 7C, an upper plate 7D and a magnetic gap 7A;

b. a plastic frame 1 connected to the magnetic circuit 7;

c. a voice coil 3 formed of a coil inserted in the magnetic gap 7A of magnetic circuit 7, and a voice coil bobbin around which the coil is wound;

d. a damper 4 for supporting the voice coil 3, said damper 4 being connected at an inner circumference with the voice coil 3, and at an outer circumference with the frame 1;

e. a diaphragm 5 connected at an outer circumference with the frame 1 via an edge portion, and at an inner circumference with the voice coil 3; and f. a speaker terminal (hereinafter referred to as ST) 2 mounted to the frame 1.

A conventional speaker further comprises:

a pair of relay terminals 9 for internal connection, attached to the frame 1;

a flexible wire (hereinafter referred to as FW) 6, one end being connected with an end of the coil of the voice coil, and the other end being connected with the relay terminal 9; and a relay cord 10, one end being connected with the relay terminal 9, and the other end being connected with a terminal plate 2*b*.

The above-described ST 2 comprises:

a case 2A for accepting a connector coupled to a sound signal amplifier of an apparatus (not shown);

the terminal plate 2*b* provided in the case 2A by a press-fitting method or by outsert molding, for coupling with the connector; and a terminal hole 2*c* formed in terminal plate 2*b* into which the relay cord 10 (to be described later) is inserted to be soldered.

In the above-configured conventional speaker, the FW 6 should always be managed to not make contact with neighboring components (damper, diaphragm), even when the ST 2 is located close to the diaphragm 5. When FW 6 makes contact with the neighboring components, the speaker generates abnormal sounds, or in some cases it is broken.

During assembly of conventional speakers, operators carefully placed the FW 6 in a location most appropriate for avoiding the above-described collision of the components. The connecting operation around the relay terminal 9 requires special skills and laborious work; therefore, it is one of the costly items in the assembly of speakers. In addition, the conventional speakers have many connection points (soldering points), which means that they have a relatively high possibility of poor connections or broken wires.

DISCLOSURE OF THE INVENTION

The present invention addresses the above problems, and a speaker in accordance with the present invention comprises:

a FW which is connected at one end with a winding of a voice coil, and at another end with a terminal plate of a ST mounted on a frame;

a clamping portion provided on the frame at a place between the voice coil and the ST, which relay portion comprises a clamping section for clamping the FW; and a wall section formed at the voice coil side of the clamping portion for having the FW disposed along the surface.

The clamping portion clamps a FW to fix it in place, while the wall section regulates a position of the FW. Under the above configuration, a relay cord can be eliminated. Thus, the number of components can be reduced, and generation of abnormal sounds during operation of a speaker due to collisions of a vibrating FW with other components (damper, diaphragm) can be avoided in accordance with the present invention to provide an excellent speaker.

BEST MODE FOR CARRYING OUT THE INVENTION

First Embodiment

Figure 1:
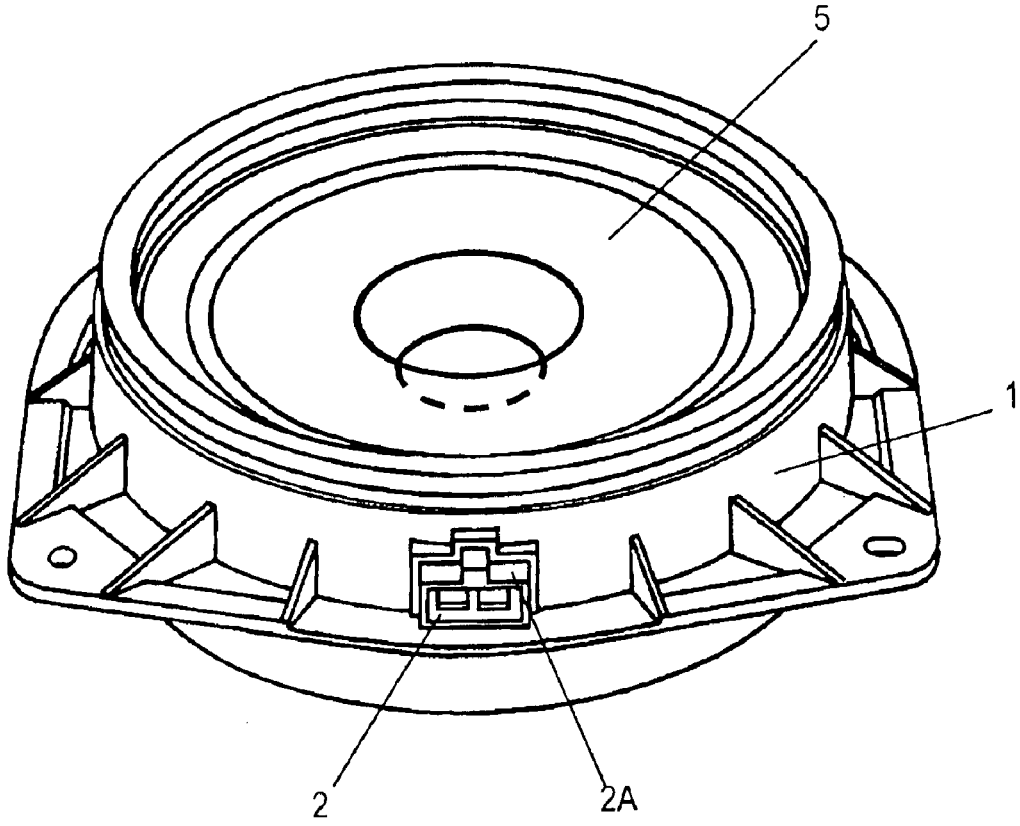
FIG. 1 shows a perspective view of a speaker in accordance with the present invention.

A speaker in accordance with a first exemplary embodiment of the present invention is described referring to FIGS. 1 through 5. Constituent parts identical to those in the conventional technology are designated using the same numerals, and descriptions thereof are omitted.

As shown in FIGS. 1 through 5, a speaker in the first embodiment comprises:

a. a magnetic circuit 7 comprising a bottom plate 7B having a center pole, a ring-shaped magnet 7C, an upper plate 7D, and a magnetic gap 7A;

b. a frame 1A made of a plastic material and fixed to the magnetic circuit 7;

c. a voice coil 3 inserted in the magnetic gap 7A of the magnetic circuit 7;

d. a damper 4 fixed at an inner circumference to the voice coil 3 and at an outer circumference to the frame 1A, for supporting voice coil 3;

e. a diaphragm 5 fixed at an outer circumference to the frame 1A, and at an inner circumference to the voice coil 3;

f. a ST 2 mounted to the frame 1A; and g. a FW 6A connected at one end with a terminal plate 2B of ST 2, and at another end with a coil of the voice coil 3.

The voice coil 3 is formed of the coil and a voice coil bobbin around which the coil is wound.

The plastic frame 1A is attached with a relay portion 8. The relay portion 8 may be formed integrally as a part of the frame 1A, or a relay portion 8 provided separately may be mounted and fixed to the frame 1A.

The FW 6A is connected at one end to the terminal plate 2B, and at another end to the coil of voice coil 3. The FW 6A is clamped at a midpoint by the relay portion 8.

The relay portion 8 comprises:

a clamping section 8A for clamping the FW6A; and a wall section 8B provided with a slanting groove 8E.

Figure 3:
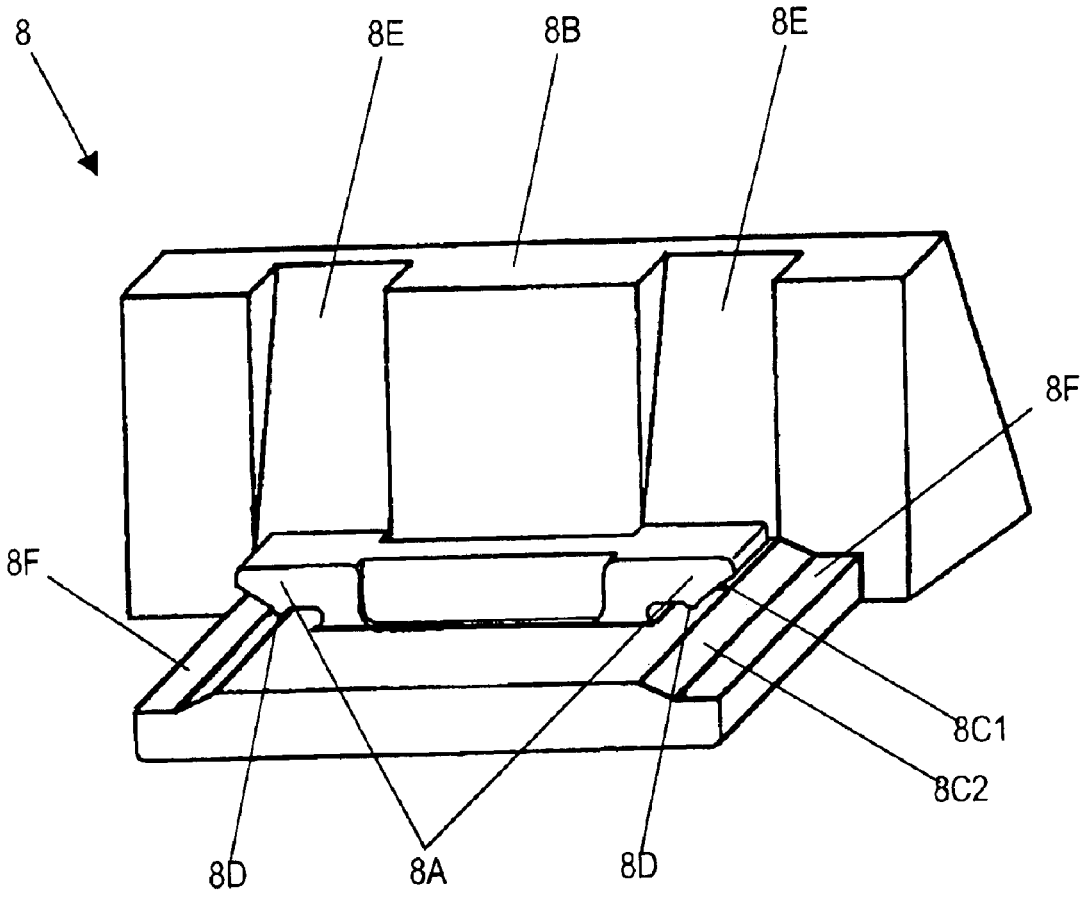
FIG. 3 is a perspective view of a relay portion of the speaker shown in FIG. 2.

As shown in FIG. 3, the wall section 8B is provided with two grooves 8E, for preventing FWs 6A with no insulation coating from making mutual contact.

In place of the grooves 8E, a protrusion may be provided on the wall section 8B between the pair of FWs 6A which is disposed along the wall.

Figure 2:
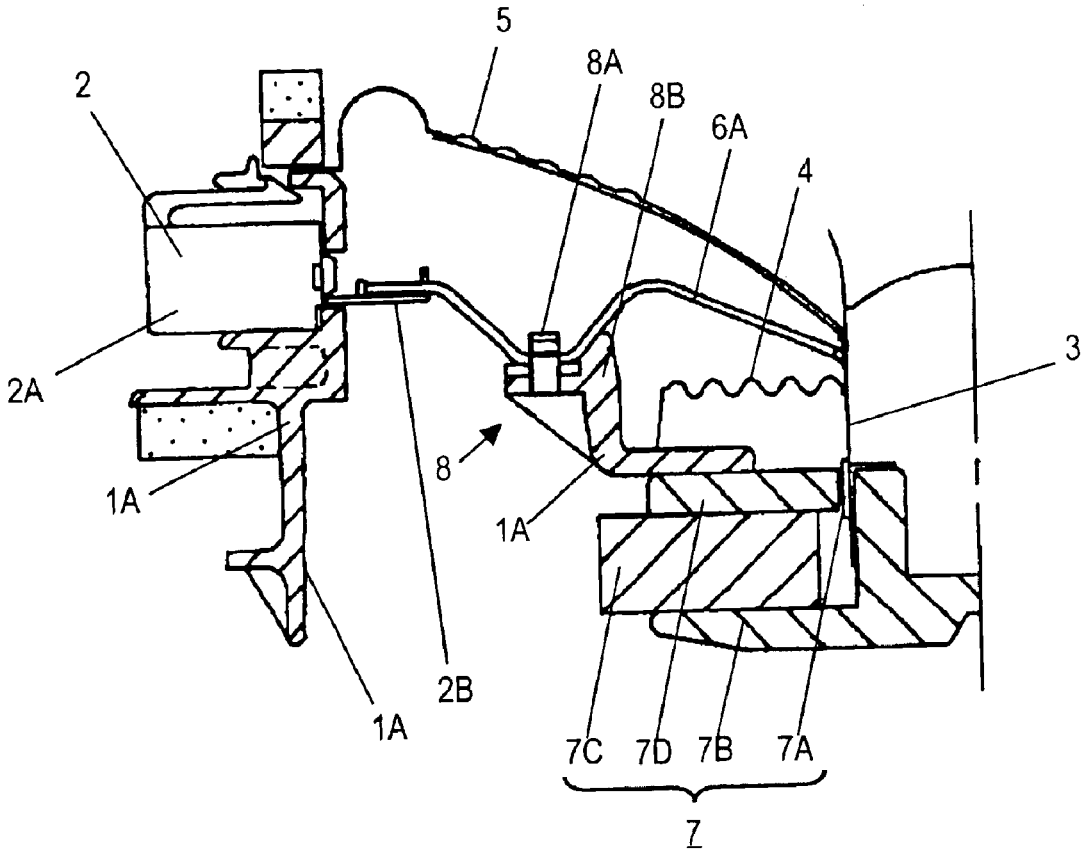
FIG. 2 is a cross sectional view showing a half portion of a speaker in accordance with an exemplary embodiment of the present invention.
Figure 4A:
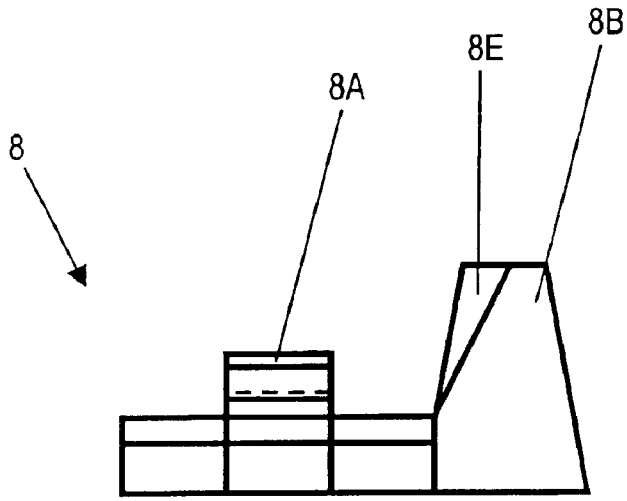
FIG. 4A is a side view of the relay portion shown in FIG. 3.
Figure 4B:
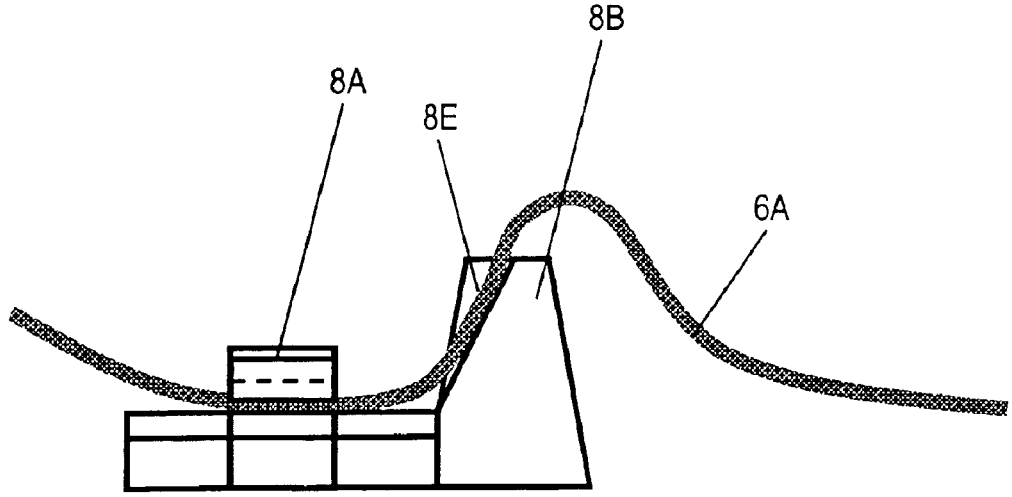
FIG. 4B is a side view of the relay portion with a FW clamped.

FIG. 4A is a side view of the relay portion 8 of FIG. 3. FIG. 4B shows a state where a FW 6A is clamped by the relay portion of FIG. 4A. As illustrated in FIG. 4B, a FW 6A is clamped at a midpoint by the clamping section 8A, and is disposed along the slanting groove 8E to make an arc shape. While the speaker is in operation, the diaphragm 5 and the damper 4 vibrate. The FW 6A is influenced by the vibration, and sometimes it vibrates itself; however, the arc shape prevents the FW 6A from vibrating in the direction toward damper 4 and diaphragm 5. An ideal location for FW 6A to avoid a collision with damper 4 or diaphragm 5 is at approximately a middle part between the diaphragm 5 and the damper 4, as illustrated in FIG. 2.

At an opening for inserting FW 6A into the clamping section 8A, an upper sloped face 8C1 and a lower sloped face 8C2 are provided and oppose each other. At a location inwardly of the upper sloped face 8C1, for example, a protrusion 8D is provided and protrudes towards a plane of the sloped face 8C2.

The sloped face 8C1 and sloped face 8C2 facilitate an easier insertion of a FW 6A towards the clamping section 8A. The protrusion 8D prevents the FW 6A from coming out of the clamping section 8A.

The above-described sloped face may be provided for either one of the faces 8C1 and 8C2 (or, such a sloped face is not an indispensable item).

Also provided is a flat portion 8F extended from the lower sloped face 8C2. During an operation for fixing a FW 6A, both ends of which are connected to the respective places, into the clamping section 8A, an operator may provisionally place a FW on the flat portion 8F, in preparation for the succeeding inserting operation. This is quite an advantage for such an inserting operation, especially for such a subtle action conducted by the help of delicate tools like tweezers. The flat portion 8F contributes to making the inserting operation easier.

Figure 5:
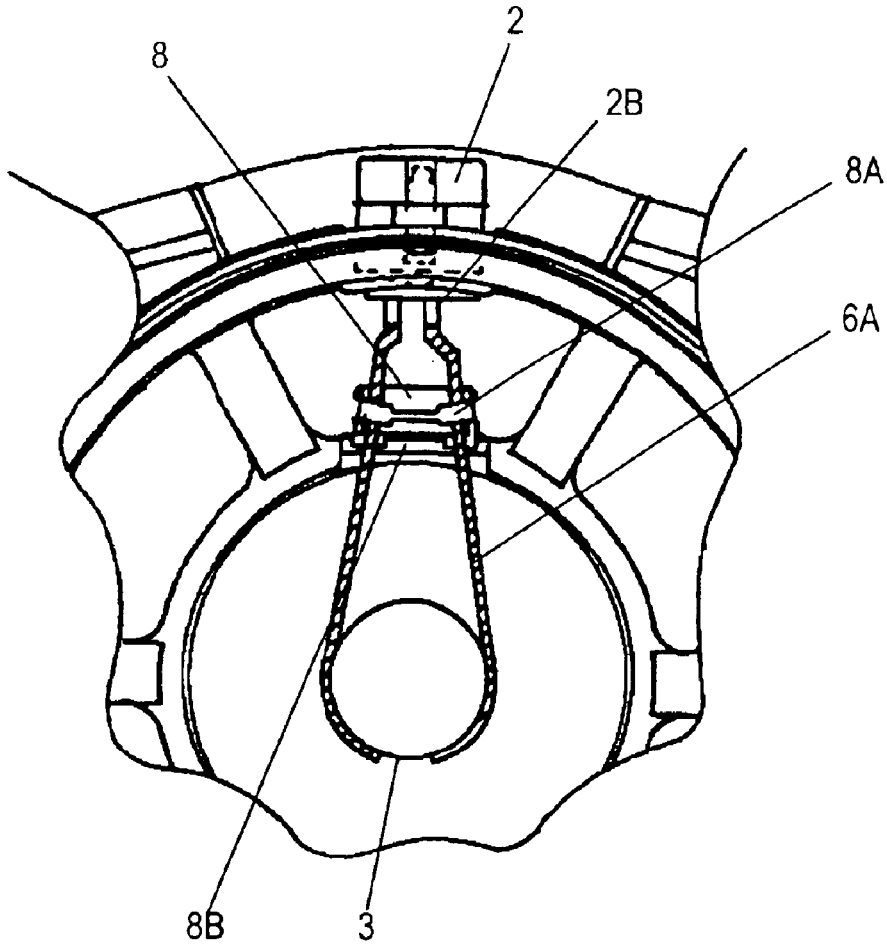
FIG. 5 shows the speaker of FIG. 2 attached with a FW, as viewed from above.

As shown in FIG. 5, the clamping section 8A of relay portion 8 is located approximately on a line connecting the terminal plate 2B and which is tangent to a circumference of voice coil 3. Therefore, a FW 6A is not always under the influence of a pulling force to take the FW 6A away from the opening of clamping section 8A.

Second Embodiment

Figure 6:
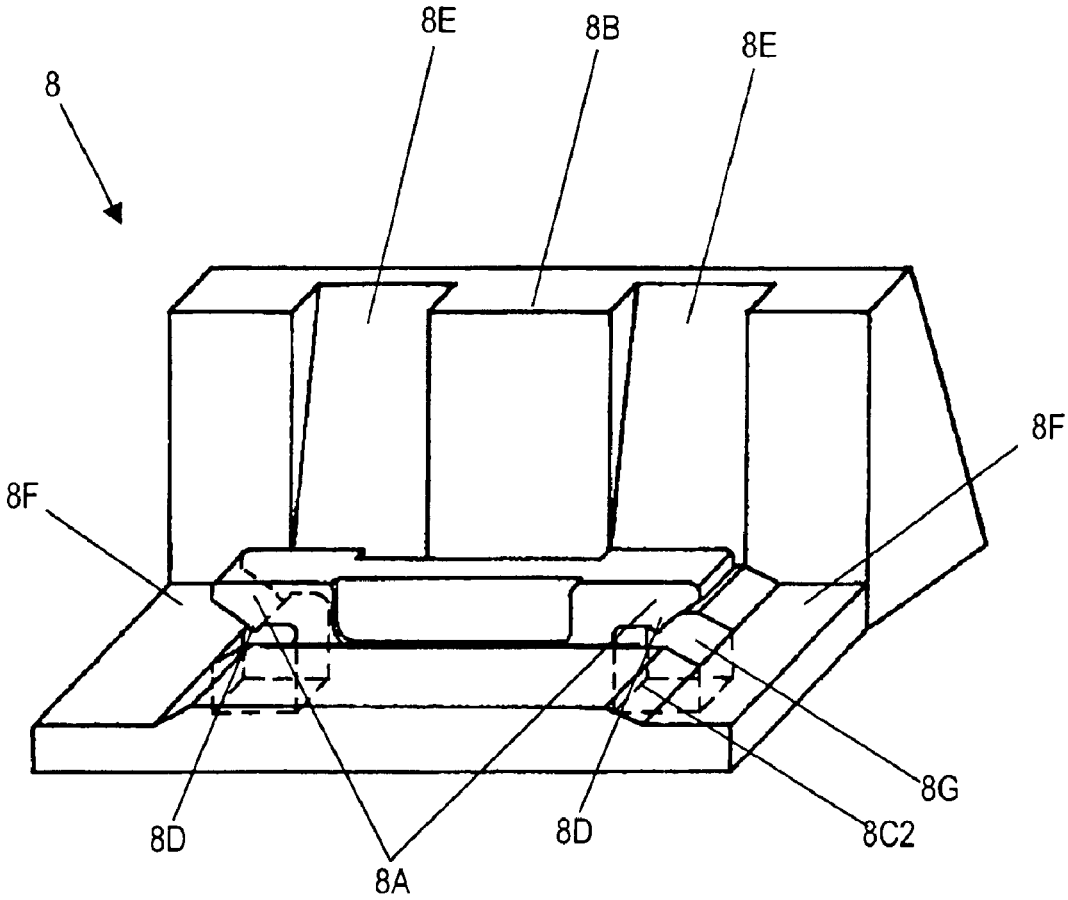
FIG. 6 shows a perspective view of another example of the relay portion.

A second exemplary embodiment of the present invention is described referring to FIG. 6. Description is made only of a difference from the first embodiment, eliminating a description of identical components.

The difference from the first embodiment is that there is a through hole 8G provided underneath a clamping position of FW 6A in the relay portion 8.

The through hole 8G facilitates visual observation from below of the status of a FW 6A being clamped. Depending on needs, a FW 6A may be fixed at the clamping section 8A by applying an adhesive agent via the through hole 8G. Thus the operation of fixing the FW 6A becomes easier, and the status of adhesion can be observed visually via the through hole 8G.

Third Embodiment

Figure 7:
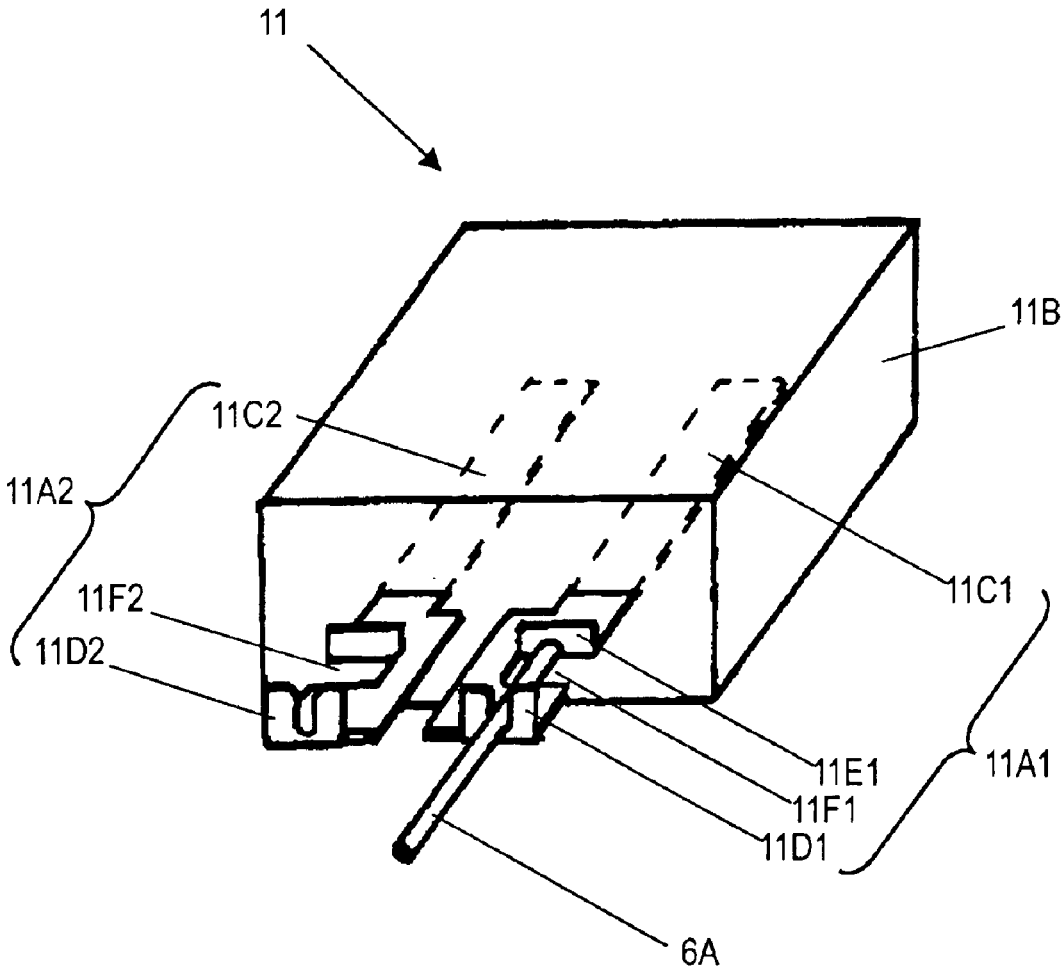
FIG. 7 shows a perspective view of another example of a ST.

A speaker terminal for use in a speaker in a third exemplary embodiment of the present invention is described referring to FIG. 7.

A ST in the conventional technology is for soldering a relay cord 10, which has a relatively high rigidity and a restriction in terms of the length is not very strict.

In the present invention, what is connecting between the ST and the voice coil 3 is a FW 6A. The FW 6A is made to be soft and flexible so that it can comply with the motion of voice coil 3. The FW 6A, however, is not allowed to make contact with neighboring components. In order to meet this requirement, the length of the FW 6A needs to be controlled within a certain specific length. A ST 11 in the present embodiment provides a structure that secures a certain specific length of a FW 6A.

As shown in FIG. 7, a ST 11 in the present embodiment comprises a casing 11B made of a plastic material having its opening at one end, and a pair of terminal plates 11A1 and 11A2 protruding through the opening of the casing 11B.

The pair of terminal plates 11A1 and 11A2 are disposed in the casing 11B by a press-fitting method or by outsert molding in the casing 11B.

Each terminal plate 11A1 comprises:

a) a terminal 11C1 of terminal plate 11A1 protruding within the casing 11B for leading electrical signals in;

b) a bent and cut end 11D1 located at another end of terminal plate 11A1 and extending out of the casing 11B for receiving a FW 6A or the like flexible wire; and c) an upright wall 11E1 formed by cutting and bending a part of the terminal plate 11A1 straight towards the casing 11B, so that the upright wall stands opposed to the bent and cut end 11D1.

As seen in FIG. 7, the terminal plate 11A1 and the terminal plate 11A2 are symmetrically disposed with respect to a middle plane. So, description of the terminal plate 11A2 is omitted.

The terminal 11C1 and 11C2 are for coupling with a connector which delivers signals from outside (not shown).

A FW 6A is connected to ST 11 in the following manner.

In the first place, a tip end of FW 6A is made to contact with the upright wall 11E1.

Under this state, the bent and cut end 11D1 is somewhat deformed so that it can hold the FW 6A for a provisional fixing.

And then, the bent and cut end 11D1 and the FW 6A are soldered.

Thus, the FW 6A is provisionally fixed with its tip end making contact with the upright wall 11E1, and then it is soldered at the bent and cut end 11D1. As a result, the FW 6A may have low dispersion in the length of a portion for connection to ST 11; accordingly, a portion connecting the voice coil 3 and the ST 11 also has a uniform length.

The above-described configuration prevents the FW 6A from making contact with neighboring components during sound reproduction by a speaker, so, no abnormal sounds will be generated by the speaker.

As a result of cutting and bending a part of terminal plate 11A1 for providing the upright wall 11E1, a cut-portion 11F1 is formed. The cut-portion 11F1 creates a narrowed section in the terminal plate 11A1, which limits conduction of the soldering heat imposed at the bend and cut end 11D1 towards the casing 11B. The upright wall 11E1 also plays a role as a heat dissipating fin.

The terminal plate 11A2 is symmetrical to the terminal plate 11A1, and connection of a FW 6A to the terminal plate 11A2 is made in the same manner. So, the description is omitted.

In the above-described configuration, the influence of soldering heat on the casing 11B is restricted, and deformation of the casing 11B at the opening can be avoided. Thus, a connector can be inserted in a smooth and stable manner into a speaker terminal provided in accordance with the present invention.

The cut-portion 11F1 (11F2) may be used as a window for observing the status of soldering from below.

Fourth Embodiment

Figure 8:
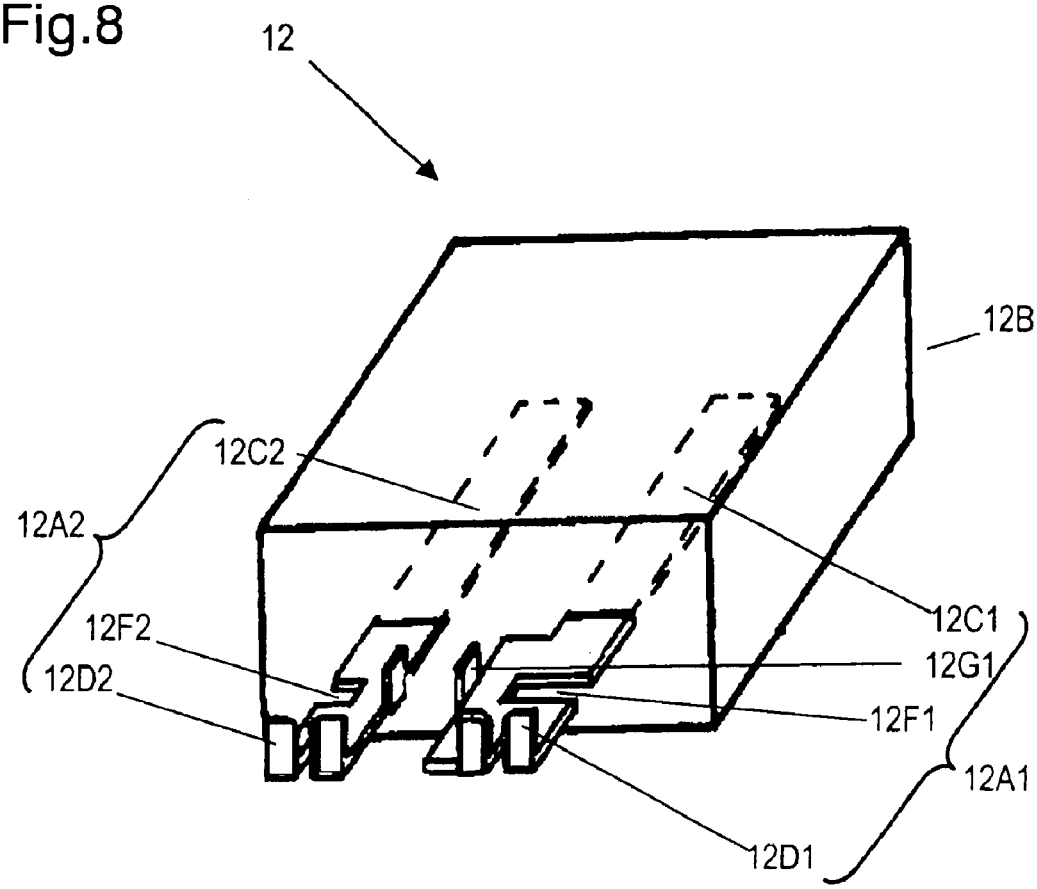
FIG. 8 shows a perspective view of still another example of the ST.
Figure 9:
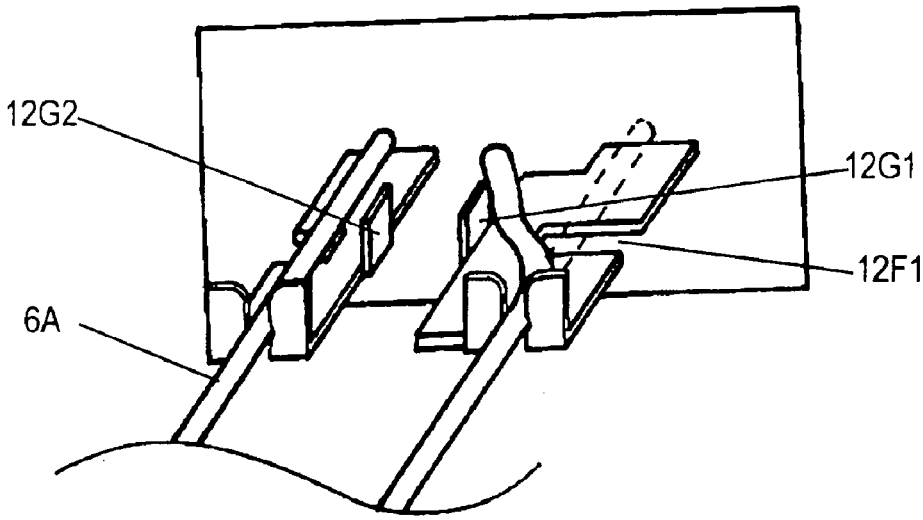
FIG. 9 is a perspective view showing how FWs are connected to the ST of FIG. 8.

Another example of a speaker terminal for use in a speaker of the present invention is described referring to FIG. 8 and FIG. 9.

A fourth exemplary embodiment also relates to a ST, like in the third embodiment.

As shown in FIG. 8, a ST 12 in the present embodiment comprises a casing 12B made of a plastic material having its opening at one end, and a pair of terminal plates 12A1 and 12A2 protruding within the opening of casing 12B.

The pair of terminal plates 12A1 and 12A2 are disposed in the casing 12B by a press-fitting method or by outsert molding in the case 12B.

The terminal plate 12A1 comprises:

a bent and cut end 12D1 provided at an end of terminal plate 12A1;

a wall 12G1 provided at a terminal plate 12A2 side in parallel to terminal plate 12A1, formed by bending a part of the terminal plate 12A1, and a cut-portion 12F1 provided in an area between the casing 12B and the bent and cut end 12D1.

The bent and cut end 12D1 is identical to the bent and cut end 11D1 in the third embodiment. The cut-portion 12F1 has an identical function as that of the cut portion 11F1 in the third embodiment.

As seen in FIG. 8, the terminal plate 12A1 and the terminal plate 12A2 are symmetrically disposed with respect to a middle plane. So, description of the terminal plate 12A2 is omitted.

The FW 6A is connected to ST 12 in the following manner;

in the first place, a tip end of the FW 6A is made to contact with the casing 12B;

at this state, the bent and cut end 12D1 is somewhat deformed so that it catches and provisionally fixes the FW 6A;

and then, the bent and cut end 12D1 and the FW 6A are soldered together.

Thus, the FW 6A is provisionally fixed with its tip end making contact with the casing 12B, and then it is soldered at the bent and cut end 12D1. As a result, the FW 6A may have least dispersion in the length of a portion for connection to ST 12; accordingly, a portion connecting the voice coil 3 and the ST 12 also has a stable length.

Thus, the present embodiment provides the FW 6A with a certain specific length required for a trustworthy connection to ST 12 on a stable basis, providing the same advantage obtained in the third embodiment.

The wall 12G1 dissipates the heat, and the cut-portion 12F1 curtails conduction of soldering heat to the casing 12B preventing deformation of the casing 12B due to the heat. Resultant troubles in insertion and pulling out of a connector can also be avoided. A possible problem to be caused by a bent tip end of the FW 6A making contact with an adjacent terminal plate 12A2 can be prevented by the wall 12G1, as the tip end of FW 6A can sometimes be bent by heat applied for soldering the FW 6A after it is provisionally fixed by the bent and cut end 12D1.

Figure 10:
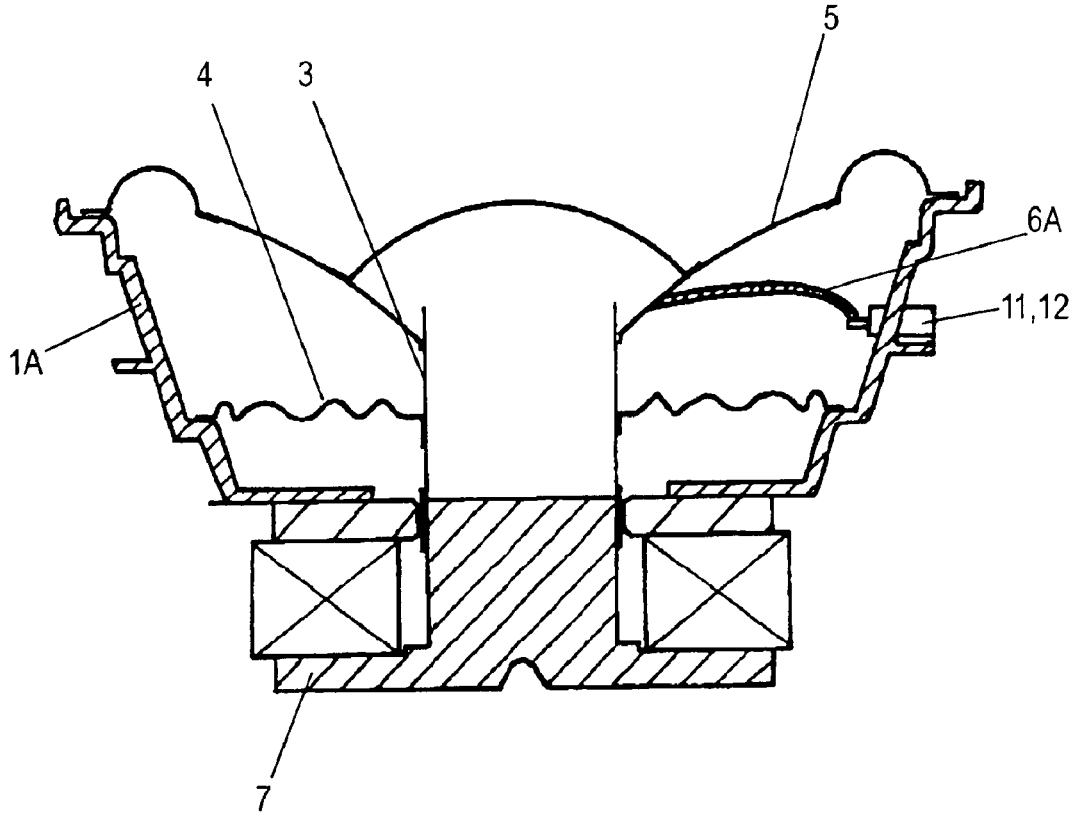
FIG. 10 is a cross-sectional view showing how a FW is connected directly to a voice coil in a speaker using the ST of FIG. 8.
Figure 11:
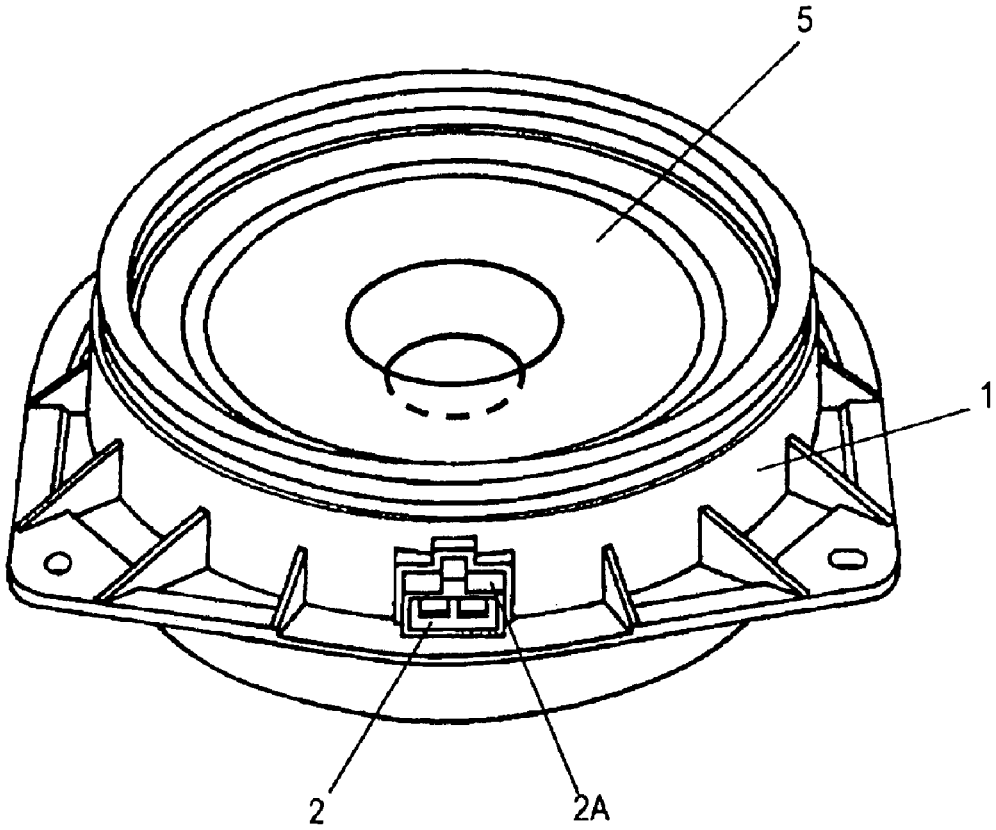
Fig.11 PRIOR ART
FIG. 11 is a perspective view of a conventional speaker.
Figure 12:
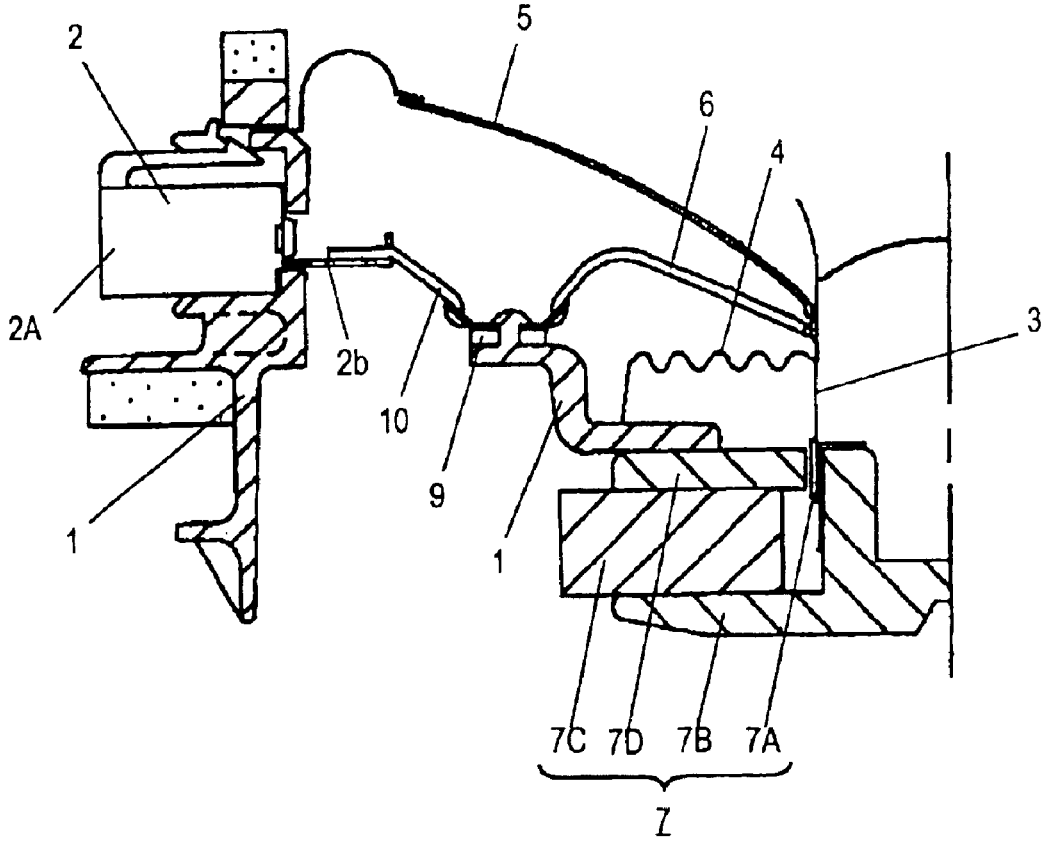
Fig.12 PRIOR ART
FIG. 12 is cross sectional view showing a half portion of the speaker of FIG. 11.
Figure 13:
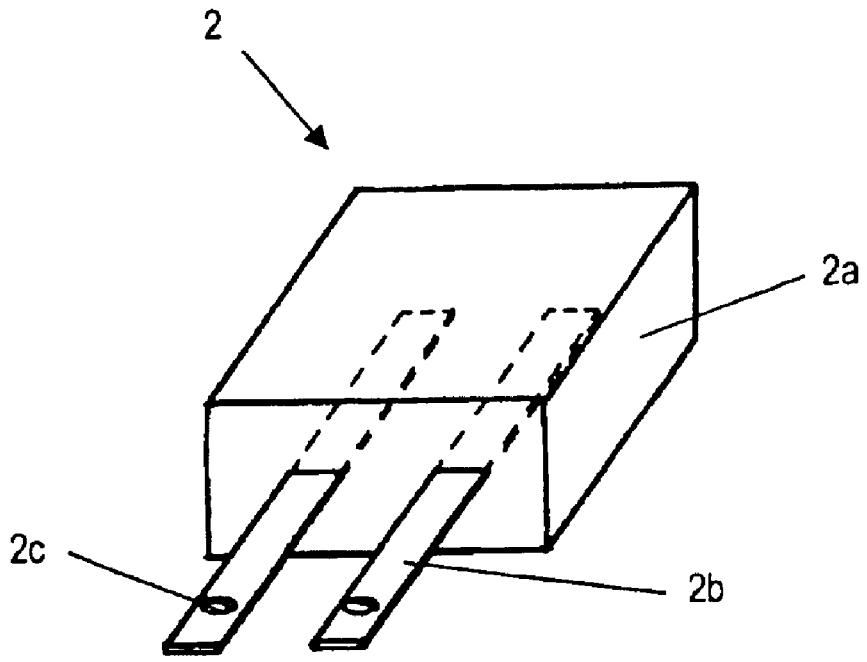
Fig.13 PRIOR ART
FIG. 13 shows a perspective view of the ST of FIG. 11.

The above-configured STs in the third and fourth embodiments can be used as well in other types of speakers which have no relay portion and no need of placing a ST at the front part. The ST may be employed in an arrangement as illustrated in FIG. 10. It provides the FW 6A with a certain regulated length on a stable basis, and effectively prevents generation of abnormal sounds caused by contacting with the neighboring components.

INDUSTRIAL APPLICABILITY

A speaker in accordance with the present invention clamps and fixes the FW with a clamping section, and regulates the position of the FW with a wall section. Thereby, a relay cord can be eliminated which contributes to a decreased number of components, and facilitates an easy assembly operation. Colliding of FWs with neighboring components during operation can be avoided to prevent abnormal sounds.

A slope provided at the clamping section in at least one of the opening faces, and a protrusion provided therein make insertion and fitting of the FW into the clamping section easier, and prevent pulling out of the FW therefrom.

A flat porch formed by extending the lower face of the opening at the clamping section functions as a guide plate for inserting a FW into the opening, making the inserting operation easier.

A pair of grooves, or a protrusion, formed in the wall of the clamping section along the running direction of the FW contributes to prevent the FW from leaning in the right/left directions, and facilitates precise placement regulation for the FW. It also contributes to preventing the uncoated FWs from making mutual contact.

A through hole provided underneath the clamping section makes it easier to observe the state of the clamped FW.

With the speaker terminals each comprising a terminal plate provided with a bent and cut end and an upright wall, the length of the FW between the ST and the voice coil can be regulated to a certain specific length on a stable basis. Thereby, the quality dispersion due to the above-described specific length of FW can be effectively suppressed, and speakers are provided with low quality dispersion.

What is claimed is:

1. A loudspeaker comprising:

a frame;

a speaker terminal mounted on said frame;

a voice coil disposed on a voice coil bobbin;

a first flexible wire having a first end and a second end;

wherein said first end of said first flexible wire is connected to said voice coil disposed on said voice coil bobbin;

wherein said second end of said first flexible wire is connected to a said speaker terminal; and wherein a relay portion is provided on said frame between said voice coil and said speaker terminal, said relay portion comprising:

a clamping section operable to clamp said first flexible wire; and a wall section provided at a voice coil side of said clamping section, wherein said first flexible wire is disposed on said wall section.

2. The loudspeaker of claim 1, wherein said clamping section is further provided with an opening through which said first flexible wire is inserted, wherein said opening is provided between two opposing faces, wherein at least one of said two opposing faces is provided with a sloped face, and wherein said clamping section is provided with a protrusion disposed inward of one of said two opposing faces.

3. The loudspeaker of claim 2, wherein said relay portion is further provided with a flat portion extending from a lower sloped face of one of said two opposing faces.

4. The loudspeaker of claim 1, further comprising a second flexible wire, wherein said wall section is provided with a first groove and a second groove, and wherein said first flexible wire is disposed in said first groove and said second flexible wire is disposed in said second groove.

5. The loudspeaker of claim 1, further comprising a second flexible wire, wherein a protrusion is provided on said wall section of said relay portion for preventing said first flexible wire and said second flexible wire from making mutual contact.

6. The loudspeaker of claim 1, wherein said relay portion is further provided with a through hole disposed beneath said clamping section.

7. The loudspeaker of claim 1, wherein said speaker terminal comprises:

a casing having an opening; and a terminal plate integrated in said casing, wherein said terminal plate comprises:

a terminal disposed within said casing for receiving electrical signals from an external sound source;

a bent and cut end disposed outside of said casing; and an upright wall opposing said bent and cut end, wherein said upright wall is disposed between said casing and said bent and cut end.

8. The loudspeaker of claim 7, wherein said terminal plate of said speaker terminal is provided with a cut-portion disposed between said upright wall and said bent and cut end.

9. The loudspeaker of claim 1, wherein said speaker terminal further comprises:

a casing having an opening; and a pair of terminal plates integrated in said casing, wherein each of said terminal plates comprises:

a terminal disposed within said casing for receiving electrical signals from an external sound source;

a bent and cut end disposed outside of said casing; and a wall disposed between said bent and cut end and said casing.

10. The loudspeaker of claim 9, wherein each of said terminal plates of said speaker terminal is provided with a cut-portion disposed between said bent and cut end and said wall.

11. The loudspeaker of claim 1, wherein said first end of said first flexible wire is connected to said voice coil in a manner such that said first flexible wire partially surrounds said voice coil.

12. The loudspeaker of claim 1, wherein said wall section comprises a slanted portion on which said first flexible wire is disposed.

13. A loudspeaker comprising:

a frame;

a speaker terminal mounted on said frame;

a voice coil;

a first flexible wire having a first end and a second end;

wherein said first end of said first flexible wire is connected to said voice coil;

wherein said second end of said first flexible wire is connected to said speaker terminal; and wherein a relay portion is disposed on said frame between said voice coil and said speaker terminal, said relay portion comprising:

a clamping section operable to clamp said first flexible wire, wherein said clamping section is provided with an opening through which said first flexible wire is inserted, wherein said opening is provided between two opposing faces, wherein at least one of the said opposing faces is provided with a sloped face, and wherein said clamping section is provided with a protrusion for maintaining the first flexible wire within said opening.

14. The loudspeaker of claim 13, further comprising:

a second flexible wire; and a wall section provided at a voice coil side of said clamping section, wherein said wall section is provided with a first groove and a second groove, and wherein said first flexible wire is disposed in said first groove and said second flexible wire is disposed in said second groove.

15. The loudspeaker of claim 14, wherein a protrusion is provided on said wall section of said relay portion for preventing said first flexible wire and said second flexible wire from making mutual contact.

16. The loudspeaker of claim 14, wherein said first groove is formed as a first slanted portion and said second groove is formed as a second slanted portion.

17. The loudspeaker of claim 13, wherein said speaker terminal comprises:

a casing having an opening; and a terminal plate integrated in said casing, wherein said terminal plate comprises:

a terminal disposed within said casing for receiving electrical signals from an external sound source;

a bent and cut end disposed outside of said casing; and a wall opposing said bent and cut end, wherein said wall is disposed between said casing and said bent and cut end.

18. The loudspeaker of claim 17, wherein said terminal plate is provided with a cut-portion disposed between said wall and said bent and cut end.

19. The loudspeaker of claim 13, wherein said first end of said first flexible wire is connected to said voice coil in a manner such that said first flexible wire partially surrounds said voice coil.

20. A loudspeaker comprising:

a frame;

a speaker terminal mounted on said frame;

a voice coil;

a flexible wire having a first end and a second end;

a relay portion disposed on said frame between said voice coil and said speaker terminal, said relay portion comprising:

a clamping section operable to clamp said flexible wire; and a wall section provided at a voice coil side of said clamping section, wherein said wall section is provided with a slanted portion on which the flexible wire is disposed; and wherein a height of said wall section is greater than a height of said clamping section.

21. The loudspeaker of claim 20, wherein said clamping section is provided with an opening through which said flexible wire is inserted;

wherein said opening is provided between two opposing faces, and wherein at least one of the said opposing faces is provided with a sloped face.

22. The loudspeaker of claim 20, wherein said clamping section is provided with a protrusion for maintaining said flexible wire within said opening.

* * * * *

UNITED STATES PATENT AND TRADEMARK OFFICE

CERTIFICATE OF CORRECTION

PATENT NO. : 6,922,477 B1
DATED : July 26, 2005
INVENTOR(S) : Junzo Ikeyama

It is certified that error appears in the above-identified patent and that said Letters Patent is hereby corrected as shown below:

Column 7,
Line 13, replace “to a said” with -- to said --.

Column 10,
Line 6, replace “disposed;” with -- disposed, --.
Line 11, replace “inserted;” with -- inserted, --.

Signed and Sealed this

Sixth Day of December, 2005

JON W. DUDAS
*Director of the United States Patent and Trademark Office*